US006427113B1

(12) United States Patent
Rahman

(10) Patent No.: US 6,427,113 B1
(45) Date of Patent: Jul. 30, 2002

(54) METHOD FOR CONTROLLING TRAFFIC

(75) Inventor: Mohammed Rezaur Rahman, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 237 days.

(21) Appl. No.: 09/129,285

(22) Filed: Aug. 5, 1998

(51) Int. Cl.[7] ..... G08G 1/00

(52) U.S. Cl. ..... 701/117; 701/213; 342/357.06; 340/907; 340/909; 340/910; 340/917

(58) Field of Search ..... 701/117, 118, 701/119, 200, 207, 209, 213, 23, 24, 26; 340/907, 909, 910, 916, 917, 918, 463, 464; 342/357.01, 357.06, 357.09, 357.12, 450, 454

(56) References Cited

U.S. PATENT DOCUMENTS 4,390,951 A * 6/1983 Marcy ..... 701/117
5,689,252 A * 11/1997 Ayanoglu et al. ..... 340/991

* cited by examiner

*Primary Examiner*—Yonel Beaulieu
(74) *Attorney, Agent, or Firm*—Trop, Pruner & Hu, P.C.

(57) ABSTRACT

The traffic control system uses global positioning system information from a variety of vehicles, analyzes that information and uses it to provide control signals to traffic control devices. For example, a base station may use information about vehicle patterns and vehicle speeds to control traffic signals, speed limit indicators, and traffic metering lights. In turn, the base station can provide information back to the vehicle about traffic patterns. This enables the driver to make his or her own determination about vehicle patterns. The traffic pattern information may also be used with a GPS navigator to automatically plot a preferred path around adverse traffic conditions.

7 Claims, 2 Drawing Sheets

METHOD FOR CONTROLLING TRAFFIC

BACKGROUND OF THE INVENTION

This invention relates generally to techniques for controlling the flow of vehicular traffic.

Traffic engineers use a variety of techniques to attempt to alleviate traffic congestion on existing roads and highways. Among the traffic control devices that are utilized are variable speed limits, traffic metering lights, variable traffic signs and traffic signals. Traffic signals include changeable stop signs and stop lights. Speed limit signs may be made variable for example, by having a graphical display board which can receive a signal and change the appropriate speed limit based on traffic conditions. Metering lights are generally utilized on feeder roads onto highways. These lights control when a vehicle can enter a major highway.

While, in general, it is possible to design traffic control systems which account for normal patterns of traffic, whenever anything unusual happens existing traffic control patterns generally have problems. In the case of traffic accidents, bad weather conditions and special events, existing traffic control systems are not sufficiently adaptable to accommodate these conditions. As a result, traffic conditions worsen and severe delays may result.

Thus, there is a continuing demand for traffic control devices which facilitate the control of traffic under varying traffic conditions.

SUMMARY OF THE INVENTION

In accordance with one aspect of the present invention, a method for controlling traffic includes developing global positioning system information about a plurality of vehicles. Traffic patterns are analyzed based on the information. Traffic control signals are developed based on the traffic patterns and traffic control signals are transmitted to traffic control devices.

DETAILED DESCRIPTION

Figure 1:
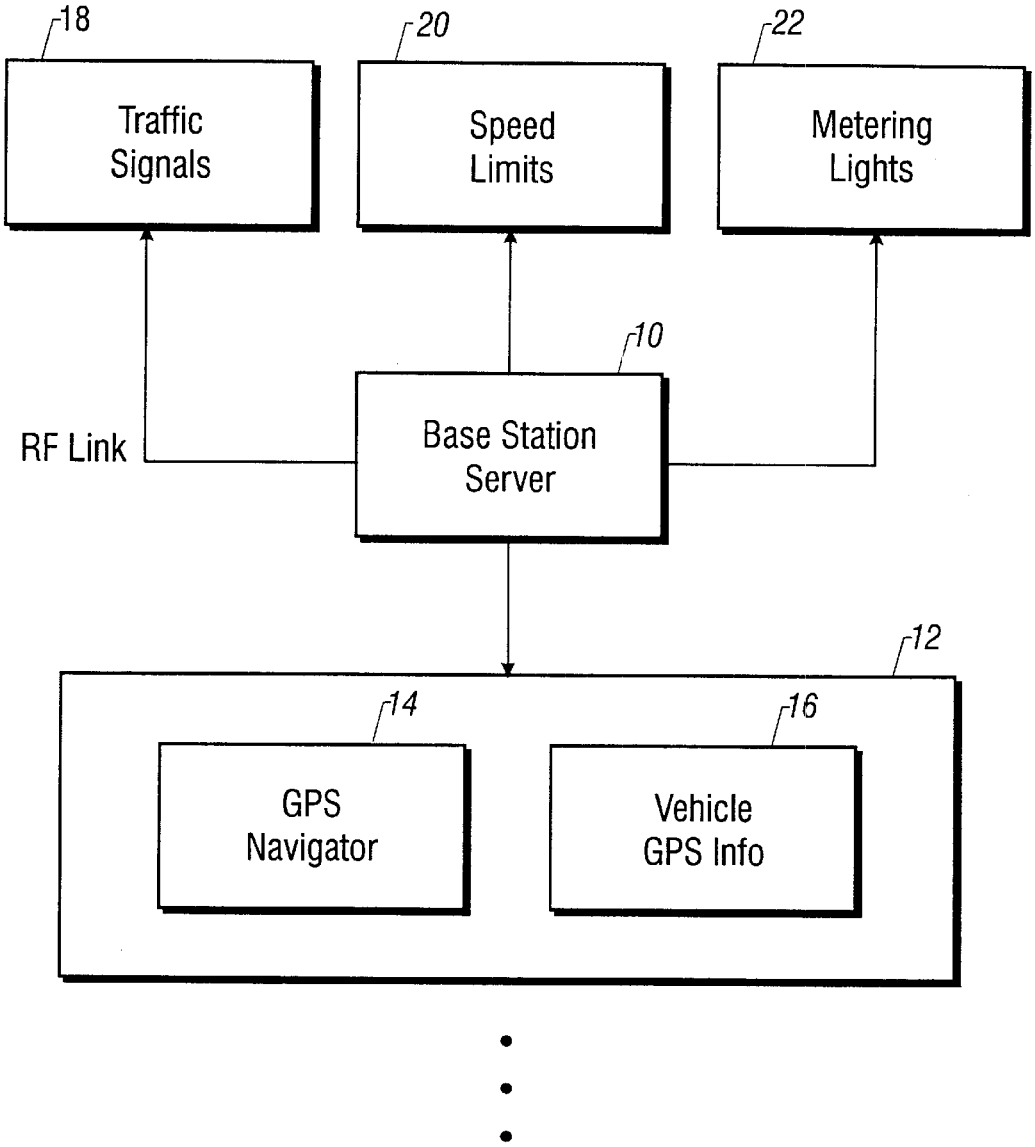
FIG. 1 is a block diagram showing a traffic control system.

Referring to FIG. 1, a traffic control system includes a base station server 10 and a plurality of vehicular units 12. Each unit 12 may be either an automobile or truck. A unit 12 may include a global positioning system (GPS) navigator 14 and a repository of vehicular global positioning system information 16. The global positioning system information contained in the repository 16 may be obtained through normal GPS techniques, coordinating with satellites to determine the vehicle's speed and position at any desired time. The navigator 14 may use the GPS information to position the vehicle with respect to a planned path of travel. For example, the GPS navigator may show the vehicle on a digital map and indicate a course which the driver should follow.

By making the unit 12 communicate with the base station server 10, not only may the base station server receive the vehicular GPS information, it can also provide real time information back to the vehicle to facilitate trip planning. That is, based on the collected information about where other vehicles are and traffic conditions, the server 10 may suggest alternate routing to the GPS navigator 14. It can do this through information about the number of vehicles that are at a particular location as well as velocity information obtained through the GPS repository 16.

Base station server 10 can utilize the GPS information obtained from a plurality of vehicles to regulate traffic control devices. For example, the base station server 10 may communicate with traffic signals 18, changeable traffic or speed limit signs 20 and metering lights 22. It may do this in a variety of ways. The system may be hard wired. The system may alternatively communicate with the traffic control devices through a coded radio or cellular phone (RF) link. Based on traffic conditions, the server 10 may change the speed limit signs 20 to increase or decrease speed limits. Similarly, traffic signals 18 can be adjusted based on traffic congestion. Likewise, metering lights 22 may be adjusted based on computerized analysis of traffic flow patterns to maximize the traffic flow rate.

Figure 2:
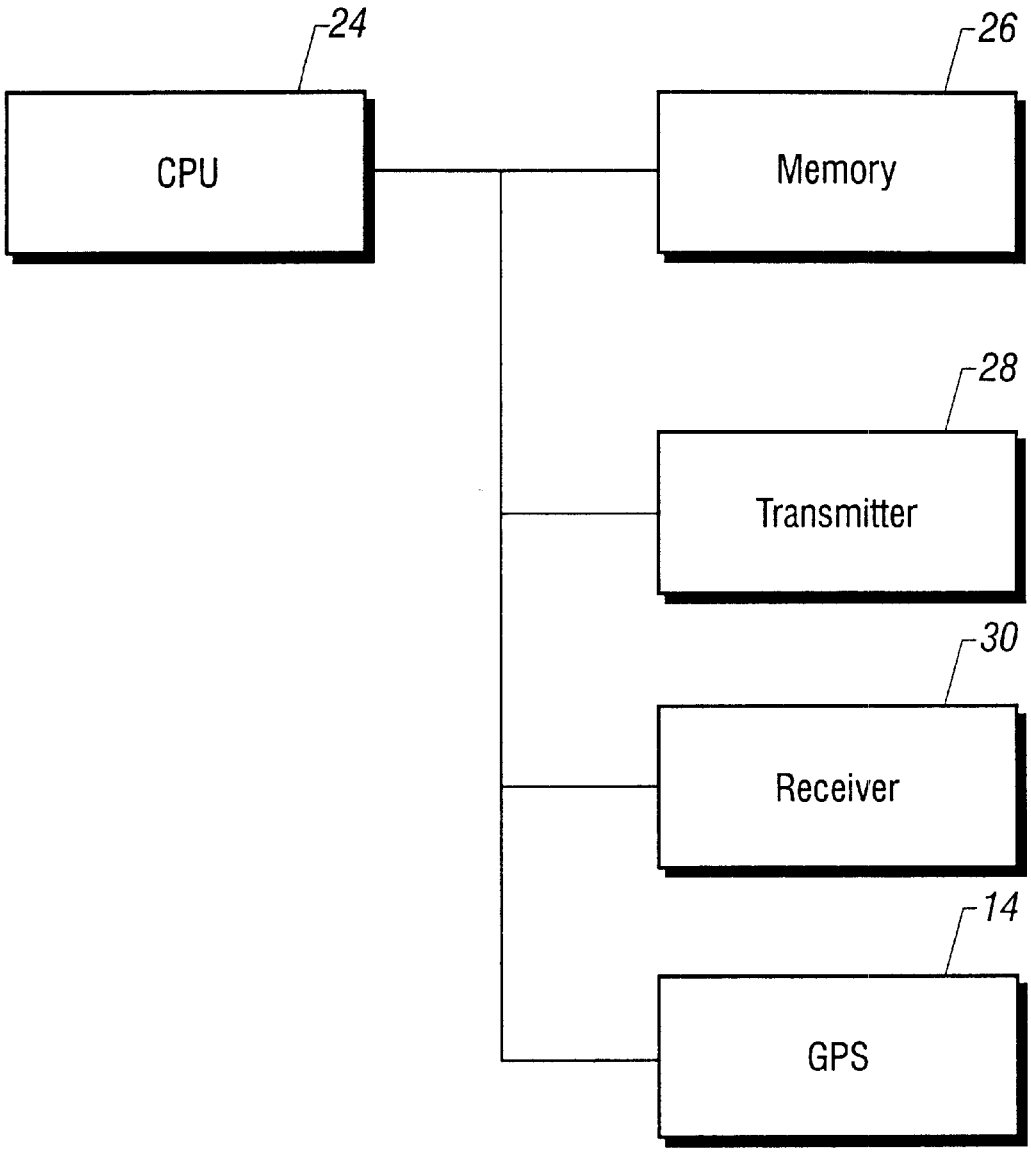
FIG. 2 is a block diagram showing a traffic control unit locatable in a particular vehicle.

Referring now to FIG. 2, each vehicle 12 may include a central processing unit (CPU) 24 and a system memory 26. A transmitter 28 and receiver 30 may communicate with the CPU 24 using conventional techniques. The transmitter 28 enables the CPU to communicate with the base station server 10 and likewise receiver 30 allows the CPU 24 to receive information about traffic conditions from the server 10. An RF communications link may be used between the server and the vehicle. In this way the GPS navigator 14 may use real time information from the base station server 10 to either map a desired path for the driver or indicate to the driver where traffic congestion exists. The driver then can navigate around the congested conditions.

While the illustrated embodiment is one in which the navigation processing activities are done at the local vehicular unit 12, it is also possible that all GPS navigation determinations may be done at the base station 10 and simply transmitted to the local unit 12. While this may increase the communication complexity, it decreases the amount of computational power required at each vehicular unit 12.

Certainly the more vehicles which have the GPS information 16, the greater the amount of information available to server 10 to make traffic control decisions. However, it is not necessary for every vehicle to have a GPS system. If a statistically significant sample of vehicles on the road provide the GPS information, the server 10 can make informed decisions about the best traffic control routings. While the present invention has been described with respect to a single preferred embodiment, those skilled in the art will appreciate numerous modifications and variations therefrom. It is intended that the appended claims cover all such modifications and variations as fall within the true spirit and scope of the present invention.

What is claimed is:

1. A method for controlling traffic comprising:

developing global positioning system information about a plurality of vehicles;

analyzing traffic patterns based on said information;

developing traffic control signals based on said traffic patterns; and transmitting said traffic control signals to traffic control devices.

2. The method of claim 1 including regulating traffic lights based on said traffic patterns.

3. The method of claim 1 including regulating speed limits based on said traffic information.

4. The method of claim 1 including regulating metering lights based on said traffic information.

5. The method of claim 1 including transmitting information to said traffic control devices over a radio link.

6. The method of claim 1 including transmitting real time information about said traffic patterns to individual vehicles to enable course determination based on real time traffic information.

7. The method of claim 6 including using said traffic pattern information in a GPS navigator to automatically route the individual vehicles based on traffic patterns.

* * * * *